US007360610B2

(12) United States Patent
Hall et al.

(10) Patent No.: US 7,360,610 B2
(45) **Date of Patent: *Apr. 22, 2008**

(54) DRILL BIT ASSEMBLY FOR DIRECTIONAL DRILLING

(76) Inventors: David R. Hall, 2185 S. Larsen Pkwy., Provo, UT (US) 84606; Francis E. Leany, 2185 S. Larsen Pkwy., Provo, UT (US) 84606; Scott Dahlgren, 2185 S. Larsen Pkwy., Provo, UT (US) 84606; David Lundgreen, 2185 S. Larsen Pkwy., Provo, UT (US) 84606; Daryl N. Wise, 2185 S. Larsen Pkwy., Provo, UT (US) 84606

( * ) Notice: Subject to any disclaimer, the term of this patent is extended or adjusted under 35 U.S.C. 154(b) by 311 days.

This patent is subject to a terminal disclaimer.

(21) Appl. No.: 11/306,976

(22) Filed: Jan. 18, 2006

(65) Prior Publication Data

US 2007/0114068 A1 May 24, 2007

Related U.S. Application Data

(63) Continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196.

(51) Int. Cl.
*E21B 7/06* (2006.01)

(52) U.S. Cl. ..... 175/61; 175/73; 175/385

(58) Field of Classification Search ..... 175/73, 175/61, 385, 399
See application file for complete search history.

(56) References Cited

U.S. PATENT DOCUMENTS

| | | | |
|---|---|---|---|
| 465,103 | A | 12/1891 | Wegner |
| 1,183,630 | A | 5/1916 | Bryson |
| 1,360,908 | A | 11/1920 | Everson |
| 1,544,757 | A | 7/1925 | Hufford |
| 2,054,255 | A | 9/1936 | Howard |
| 2,169,223 | A | 8/1939 | Christian |
| 2,466,991 | A | 4/1949 | Kammerer |
| 2,545,036 | A | 3/1951 | Kammerer |
| 2,755,071 | A | 7/1956 | Kammerer |
| 2,901,223 | A | 8/1959 | Scott |
| 2,963,102 | A | 12/1960 | Smith |
| 4,081,042 | A | 3/1978 | Johnson |

(Continued)

*Primary Examiner*—Hoang Dang
(74) *Attorney, Agent, or Firm*—Tyson J. Wilde

(57) ABSTRACT

In one aspect of the invention a drill bit assembly has a body portion intermediate a shank portion and a working portion, the working portion having at least one cutting element. A shaft is supported by the body portion and extends beyond the working portion. The shaft also has a distal end that is rotationally isolated from the body portion. In another aspect of the invention, a method for steering a downhole tool string has the following steps: providing a drill bit assembly attached to an end of the tool string disposed within a bore hole; providing a shaft extending beyond a working portion of the assembly; engaging a subterranean formation with a distal end of the shaft; and angling the drill bit assembly with the shaft along a desired drilling trajectory.

25 Claims, 18 Drawing Sheets

U.S. PATENT DOCUMENTS 4,106,577 A 8/1978 Summers
4,262,758 A * 4/1981 Evans ..... 175/73
4,416,339 A 11/1983 Baker
4,531,592 A 7/1985 Hayatdavoudi
4,597,454 A 7/1986 Schoeffler
4,612,987 A 9/1986 Cheek
4,624,306 A 11/1986 Traver
4,637,479 A 1/1987 Leising
4,679,637 A 7/1987 Cherrington
4,694,913 A 9/1987 McDonald
4,775,017 A 10/1988 Forrest
4,889,017 A 12/1989 Fuller
4,962,822 A 10/1990 Pascale
4,974,688 A * 12/1990 Helton ..... 175/73
5,009,273 A 4/1991 Grabinski
5,038,873 A 8/1991 Jurgens
5,094,304 A 3/1992 Briggs
5,103,919 A 4/1992 Warren
5,135,060 A 8/1992 Ide
5,141,063 A 8/1992 Quesenbury
5,148,875 A 9/1992 Karlsson
5,259,469 A 11/1993 Stjernstrom
5,311,953 A 5/1994 Walker
5,361,859 A 11/1994 Tibbitts
5,507,357 A 4/1996 Hult
5,553,678 A * 9/1996 Barr et al. ..... 175/73
5,568,838 A 10/1996 Struthers
5,778,991 A 7/1998 Runquist
5,904,444 A 5/1999 Kabeuchi
6,050,350 A 4/2000 Morris
6,321,858 B1 11/2001 Wentworth
6,364,034 B1 4/2002 Schoeffler
6,364,038 B1 4/2002 Driver
6,450,269 B1 9/2002 Wentworth
6,484,819 B1 11/2002 Harrison
6,513,606 B1 2/2003 Krueger
6,668,949 B1 12/2003 Rives
6,789,635 B2 9/2004 Wentworth
6,948,572 B2 9/2005 Hay
2003/0213621 A1 * 11/2003 Britten et al. ..... 175/404
2004/0222024 A1 * 11/2004 Edscer ..... 175/73
2004/0238221 A1 * 12/2004 Runia et al. ..... 175/61

* cited by examiner

DRILL BIT ASSEMBLY FOR DIRECTIONAL DRILLING

CROSS REFERENCE TO RELATED APPLICATIONS

This Patent Application is a continuation-in-part of U.S. patent application Ser. No. 11/306,307; now U.S. Pat. No. 7,225,886; filed on Dec. 22, 2005, entitled Drill Bit Assembly with an Indenting Member. U.S. patent application Ser. No. 11/306,307 is a continuation-in-part of U.S. patent application Ser. No. 11/306,022; now U.S. Pat. No. 7,198,119; filed on Dec. 14, 2005, entitled Hydraulic Drill Bit Assembly. U.S. patent application Ser. No. 11/306,022 is a continuation-in-part of U.S. patent application Ser. No. 11/164,391 now U.S. Pat. No. 7,270,196; filed on Nov. 21, 2005, which is entitled Drill Bit Assembly. All of these applications are herein incorporated by reference in their entirety.

BACKGROUND OF THE INVENTION

This invention relates to drill bit assemblies, specifically drill bit assemblies used in directional drilling. Often in oil, gas, or geothermal drilling applications subterranean formations may dictate drilling along deviated paths to avoid harsh conditions or to improve hydrocarbon production. Methods for deviating tool strings in the prior art include, but are not limited to whipstocks, bent subs, positive displacement motors, and actuators placed in bottom-hole assemblies.

U.S. Pat. No. 4,420,049 to Holbert, which is herein incorporated by reference for all that it contains, discloses directional drilling carried out by orienting and positioning a whipstock having a curved guide surface at a predetermined rotational angle with respect to the desired azimuth so as to compensate for lateral deviation of the original bore or rathole. The curved guide surface of the whipstock is given a radius of curvature in a longitudinal direction corresponding to that of the drainhole section radius and is provided with a concave face in a transverse direction which defines lateral wings along the guide surface to control the advancement of the drilling tool along the desired course and avoid objectionable helixing. Proper orientation and guidance of the drill tool by means of the radius whipstock as described permits accurate determination of the drainhole orientation vertical drill distance between the zenith and nadir of the drainhole as well as the actual drilled depth between those points.

U.S. Pat. No. 5,706,905 to Barr, which is herein incorporated by reference for all that it contains, discloses a modulated bias unit, for use in a steerable rotary drilling system, comprises a number of hydraulic actuators spaced apart around the periphery of the unit, each having a movable thrust member which is hydraulically displaceable outwardly for engagement with the formation of the borehole, and a control valve operable to bring the actuators alternately in succession into and out of communication with a source of fluid under pressure, as the bias unit rotates. The fluid pressure supplied to each actuator may thus be modulated in synchronism with rotation of the drill bit, and in selected phase relation thereto, so that each movable thrust member is displaced outwardly at the same rotational position of the bias unit so as to apply a lateral bias to the unit for the purposes of steering an associated drill bit. To enable the biasing action to be neutralized or reduced there is provided an auxiliary shut-off valve in series with the control valve, which is operable to prevent the control valve from passing the maximum supply of fluid under pressure to the hydraulic actuators.

U.S. Pat. No. 6,581,699 to Chen, et al., which is herein incorporated by reference for all that it contains, discloses a bottom hole assembly for drilling a deviated borehole and includes a positive displacement motor (PDM) or a rotary steerable device (RSD) having a substantially uniform diameter motor housing outer surface without stabilizers extending radially therefrom. In a PDM application, the motor housing may have a fixed bend therein between a first power section and a second bearing section. The long gauge bit powered by the motor may have a bit face with cutters thereon and a gauge section having a uniform diameter cylindrical surface. The gauge section preferably has an axial length at least 75% of the bit diameter. The axial spacing between the bit face and the bend of the motor housing preferably is less than twelve times the bit diameter. According to the method of the present invention, the bit may be rotated at a speed of less than 350 rpm by the PDM and/or rotation of the RSD from the surface.

U.S. Pat. No. 6,116,354 to Buytaert, which is herein incorporated by reference for all that it contains, discloses a rotary steerable system for use in a drill string for drilling a deviated well. The system utilizes a mechanical gravity reference device comprising an unbalanced weight which may rotate independently of the rotation of the drill string so that its heavy portion is always oriented toward the low side of the wellbore and which has an attached magnet. A magnetic switch that rotates as the drill string rotates is activated when its axis coincides with the axis of the magnet, and this activation results in a thrust member or pad being actuated to "kick" the side of the wellbore.

BRIEF SUMMARY OF THE INVENTION

In one aspect of the invention, a drill bit assembly has a body portion intermediate a shank portion and a working portion, the working portion having at least one cutting element. A shaft is supported by the body portion and extends beyond the working portion of the assembly. Preferably, at least a portion of the shaft is disposed within a chamber disposed within the body portion. A distal end of the shaft is also rotationally isolated from the body portion; preferably the entire shaft is rotationally isolated.

Preferably, the assembly comprises an actuator which is adapted to move the shaft independent of the body portion. The actuator may be rotationally isolated as well from the body portion. The actuator may be adapted to move the shaft parallel, normal, or diagonally with respect to an axis of the body portion. The actuator may comprise a latch, hydraulics, a magnetorheological fluid, eletrorheological fluid, a magnet, a piezoelectric material, a magnetostrictive material, a piston, a sleeve, a spring, a solenoid, a ferromagnetic shape memory alloy, a swash plate, a collar, a gear, or combinations thereof. The shaft may angle and/or offset the rest of the drill bit assembly as it is moved with enough precision that it can steer a downhole tool string along a desired trajectory. The actuator may be in communication with a downhole telemetry system such as a downhole network or a mud pulse system so that steering may be controlled from the surface.

A sleeve may be disposed within the chamber surrounding the shaft and may also be rotationally isolated from the body portion of the assembly. The sleeve in combination with rotary bearings may help to rotationally isolate the shaft from the body. During a downhole drilling operation, a distal end of the shaft may be rotationally stationary with respect to a subterranean formation and the body portion is adapted to rotate around the shaft. The distal end of the shaft may comprise a wear resistant material, which may prevent it from degrading under high compressive loads and/or in abrasive environments. The wear resistant material may be diamond, carbide, a cemented metal carbide, boron nitride, or combinations thereof.

In another aspect of the invention, a method for steering a downhole tool string has the following steps: providing a drill bit assembly attached to an end of the tool string disposed within a bore hole; providing a shaft extending beyond a working portion of the drill bit assembly, the working portion comprising at least one cutting element; engaging the formation with a distal end of a shaft, the shaft being part of the drill bit assembly; and angling the drill bit assembly with the shaft along a desired trajectory. Moving the drill bit assembly may include pushing the drill bit assembly along the desired trajectory along any plane. Moving the drill bit assembly may also include angling the shaft or pushing off of the shaft. In some aspects of the invention, the shaft advances along the desired trajectory before the drill bit assembly. In some aspects of the method, the shaft may be controlled over a network, from the surface, from a downhole electronic device, or combinations thereof.

DETAILED DESCRIPTION OF THE INVENTION AND THE PREFERRED EMBODIMENT

Figure 1:
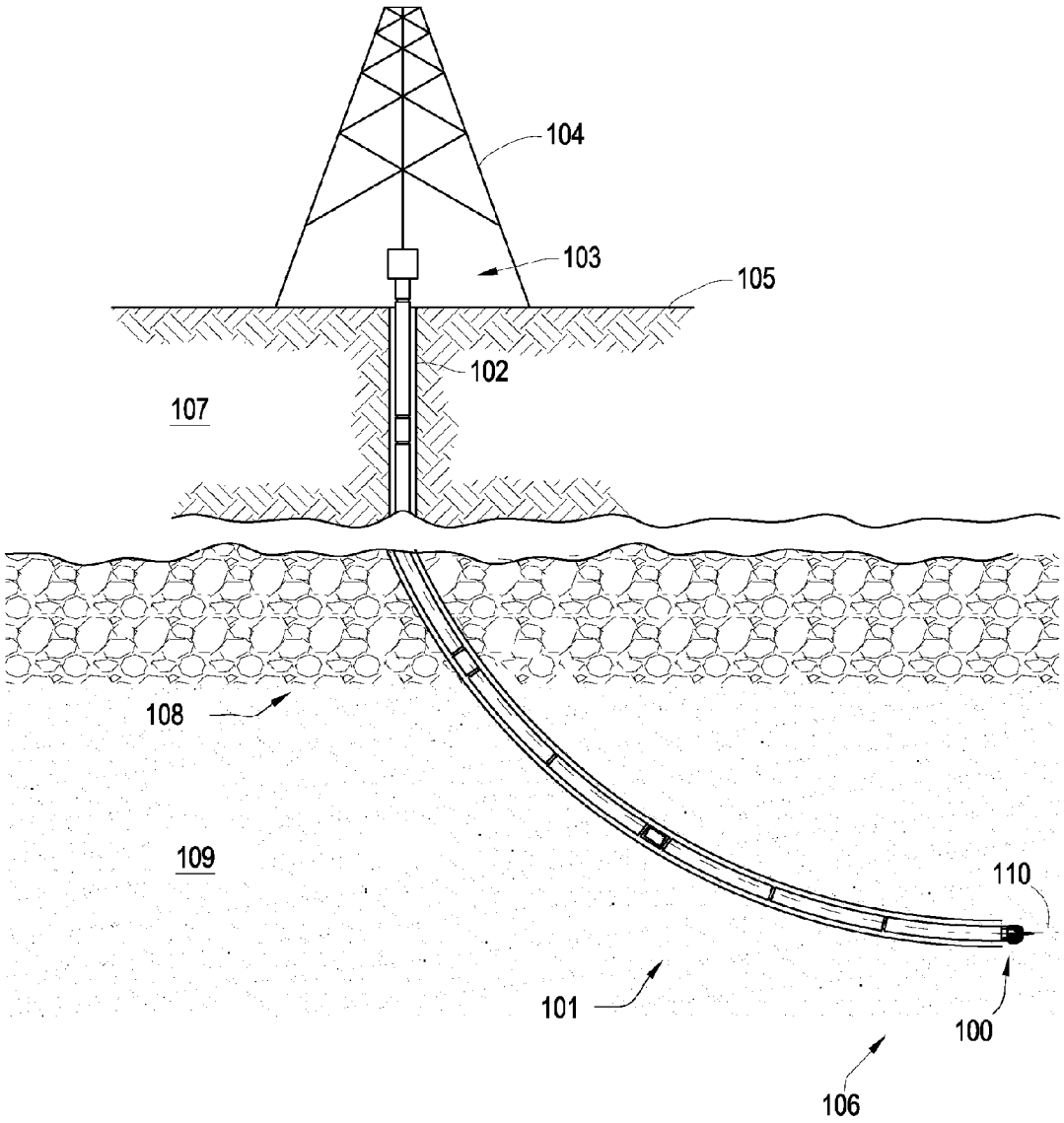
FIG. 1 is a perspective diagram of an embodiment of a drilling operation.

FIG. 1 is a perspective diagram of an embodiment of a drilling operation. A downhole tool string 101 is supported within a bore hole 102 at a first end 103 by a derrick 104 located at the surface 105 of the earth. Another end 106 of the tool string 101 is connected to a drill bit assembly 100. The earth may comprise a plurality of subterranean formations 107, 108, 109 having different characteristics such as hardness, salinity, pH and porosity. Some formations may be more economic to drill through. The drill bit assembly 100 may be adapted to guide the tool string 101 along a desired trajectory 110.

Figure 3:
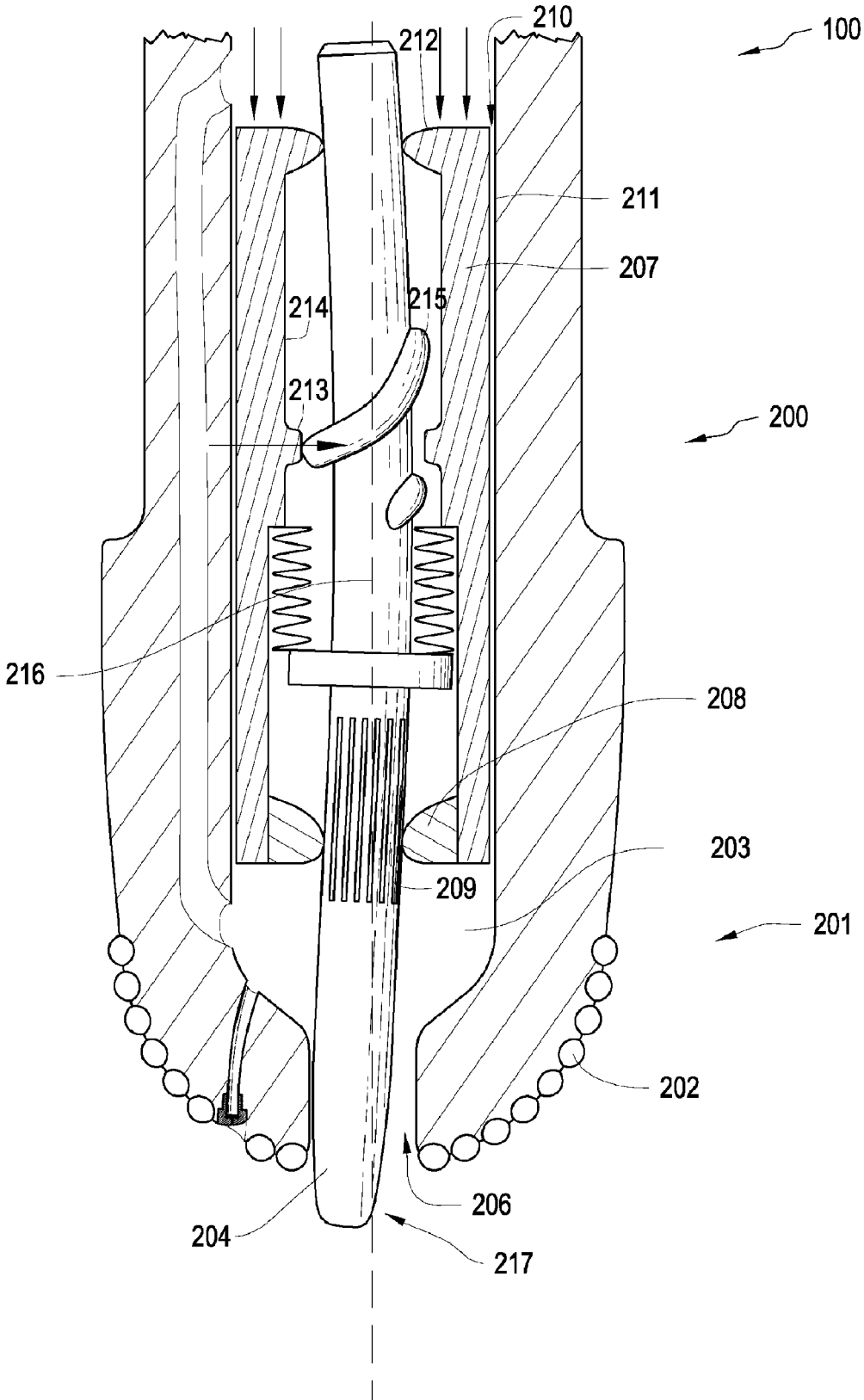
FIG. 3 is a cross sectional diagram of an embodiment of a drill bit assembly.

FIG. 3 is a cross sectional diagram of an embodiment of a drill bit assembly 100. The assembly 100 comprises a body portion 200 and a working portion 201. The working portion 201 comprises at least one cutting element 202. The cutting element 202 may comprise a superhard material such as diamond, polycrystalline diamond, or cubic boron nitride. The body portion 200 comprises a chamber 203 with at least a portion of the shaft 204 disposed within it. The chamber 203 comprises an opening 206 proximate the working portion 201 of the assembly 100. Preferably, the shaft 204 is generally coaxial with the body portion 200.

Also at least partially disposed within the chamber 203 is a sleeve 207 which surrounds the shaft 204. The sleeve 207 may comprise engaging elements 208 which fit into grooves 209 formed in the shaft 204 so as to rotationally fix the shaft 204 to the sleeve 207. The interface 210 between the sleeve 207 and wall 211 of the chamber 203 may be low friction so as to rotationally isolate the shaft 204 from the body portion 200. The sleeve may be made of steel, stainless steel, aluminum, tungsten, or any suitable material. It may be desirable for the sleeve to comprise a material with a similar electric potential so as to reduce galvanic corrosion. The chamber 203 may be exposed to pressure from the bore of the downhole tool string 101.

Drilling mud or some other suitable material may travel down the bore of the tool string 101, and at least partially engage a top face 212 of the sleeve 207. The drilling mud may pass through the interface 210 between the sleeve 207 and the wall 211 of the chamber 203 and exit through the opening 206 of the chamber 203 or through nozzles into the annulus of the bore hole 102. During a drilling operation, the position of the sleeve 207 may depend on an equilibrium of pressures including a bore pressure and a formation pressure. As the drilling mud engages the top face 212 of the sleeve 207 the bore pressure may displace the sleeve 207 such that a protrusion 213 attached to the internal wall 214 of the sleeve 207 engages a helical bulge 215 attached to the shaft 204. As the protrusion 213 and the bulge 215 engage, a force normal to a central axis 216 of the assembly 100 may be generated, which causes the shaft 204 to bend. As the shaft 204 bends, the distal end 217 of the shaft 204 may be biased in another direction. The position of the sleeve 204 may determine which part of the helical bulge 215 is engaged and therefore which direction the normal force is generated. Thus by controlling the position of the sleeve 204 within the chamber 203, the direction of the normal force may be controlled, thereby controlling the direction in which the distal end 217 is biased. The distal end 217 may comprise a symmetric or asymmetric geometry.

Figure 2:
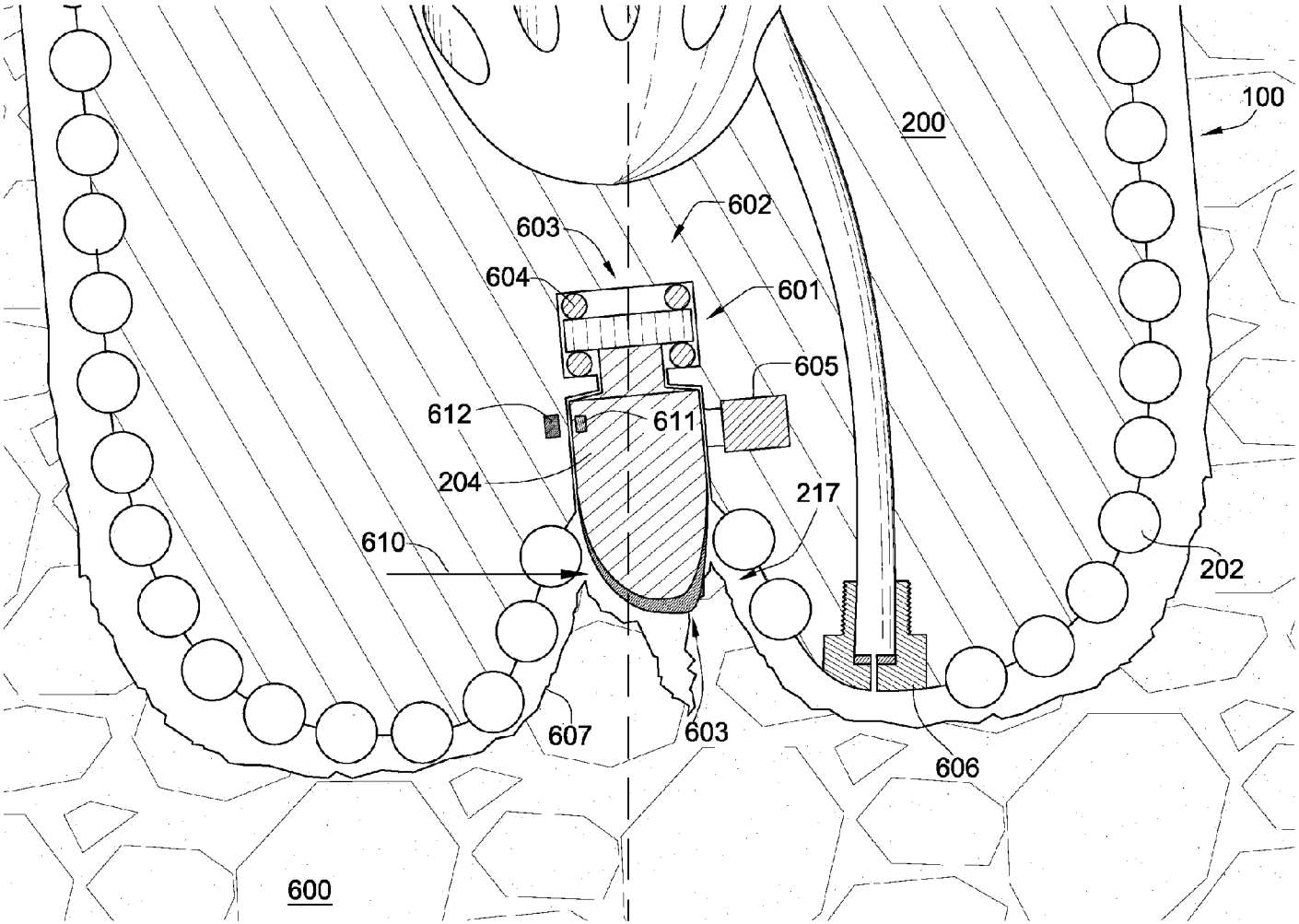
FIG. 2 is a cross sectional diagram of the preferred embodiment of a drill bit assembly.

During a drilling operation, the shaft 204 may protrude from the working portion 201 such that the distal end 217 of the shaft 204 engages a subterranean formation 600 (see FIG. 2). It is believed since the distal end 217 of the shaft 204 is rotationally isolated from the body portion 200 of the assembly 100, that a load may be applied to the shaft 204 such that the shaft 204 may become rotationally fixed to the formation 600 and the body portion 200 of the assembly 100 may rotate around the shaft 204. The distal end 217 of the shaft 204 may be used to angle the drill bit assembly 100 so that the tool string 101 will travel along a predetermined trajectory. The shaft 204 may be loaded with at least a portion of the weight of the tool string 101 and/or loaded with pressure from the bore. If the load on the shaft 204 exceeds the compressive strength of the formation 600, than the distal end 217 of the shaft 204 may penetrate the formation. In such situations, the shaft 204 may act as a pilot and the tool string may follow whatever trajectory the shaft follows. If the load on the shaft 204 does not exceed the compressive strength of the formation 600, then the shaft 204 may be used to push the drill bit assembly 100. By controlling the position of the sleeve the shaft 204 may be used to angle, maneuver, or direct the drill bit assembly 100 along predetermined trajectories. In this manner the shaft 204 may be used to steer a downhole tool string 101 by using bore pressure differentials.

Figure 4:
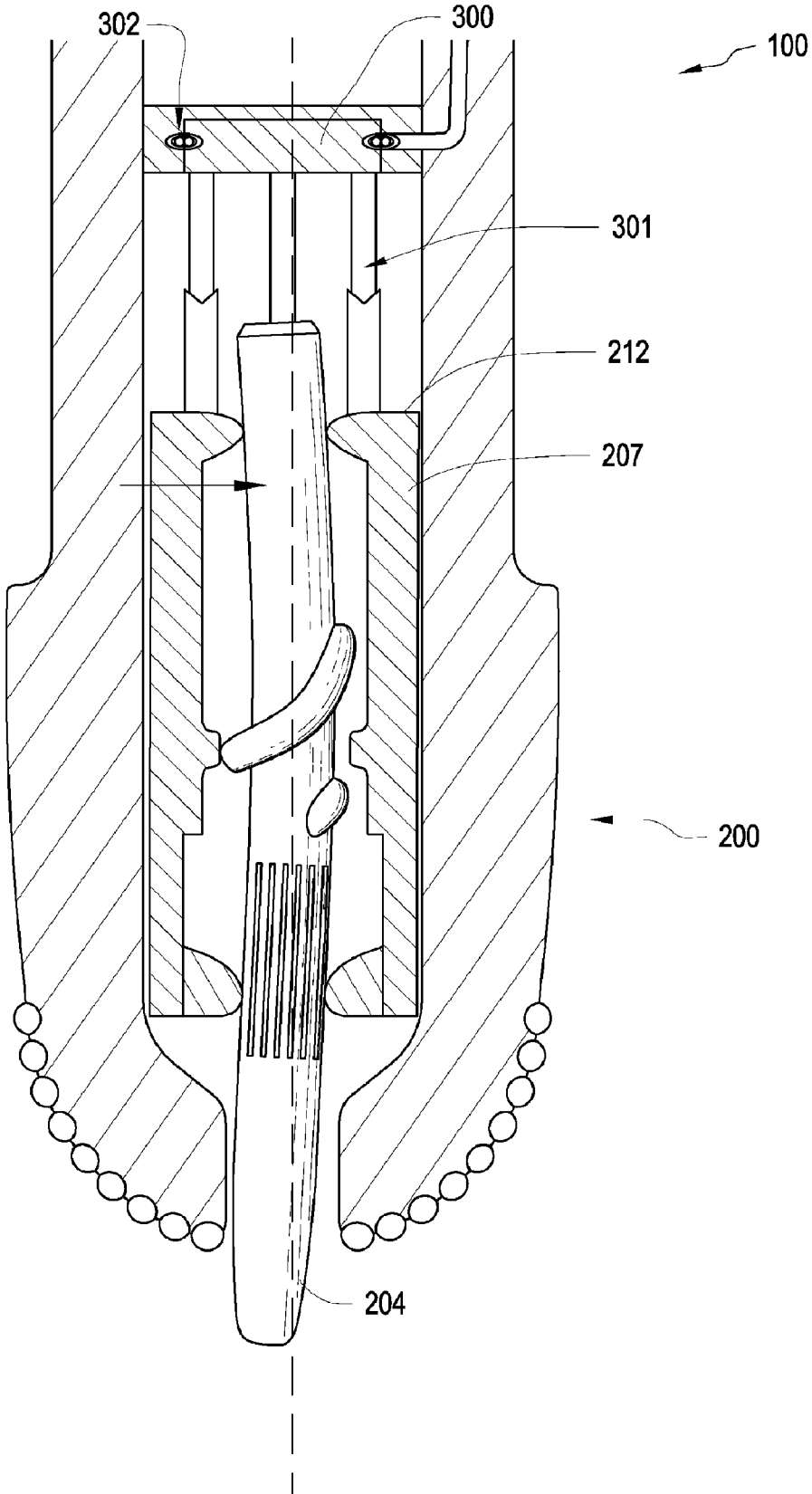
FIG. 4 is a cross sectional diagram of another embodiment of a drill bit assembly.

FIG. 4 is a cross sectional diagram of another embodiment of a drill bit assembly 100. The assembly 100 also comprises a shaft 204 which is rotationally isolated from the body portion 200. Differential rotation between the shaft 204 and body portion 200 may be generated when the shaft 204 is engaged with the formation 600. The differential rotation may be used to run a hydraulic circuit (not shown) which may be used to position the sleeve 204. As shown in FIG. 3, there is a member 300 which is rotationally fixed to the shaft 204 and located above it. A pump (not shown) is located in the rotational member 300 and uses the differential rotation to drive the hydraulic circuit. The circuit may control hydraulic pistons 301, which interface the top face 212 of the sleeve 207. Possible hydraulic circuits that may be used with the present invention are disclosed in commonly owned and co-pending U.S. application Ser. No. 11/306,022 filed on Dec. 14, 2005. Also shown in FIG. 3, is a rotary interface 302 to a downhole network 500 (shown in FIG. 6). The network may control the opening and closing of valves (not shown) that aid in controlling the position of the sleeve. Thus the shaft 204 and therefore the direction of the tool string 101 may be controlled by using differential rotation in the drill bit assembly 100.

Figure 5:
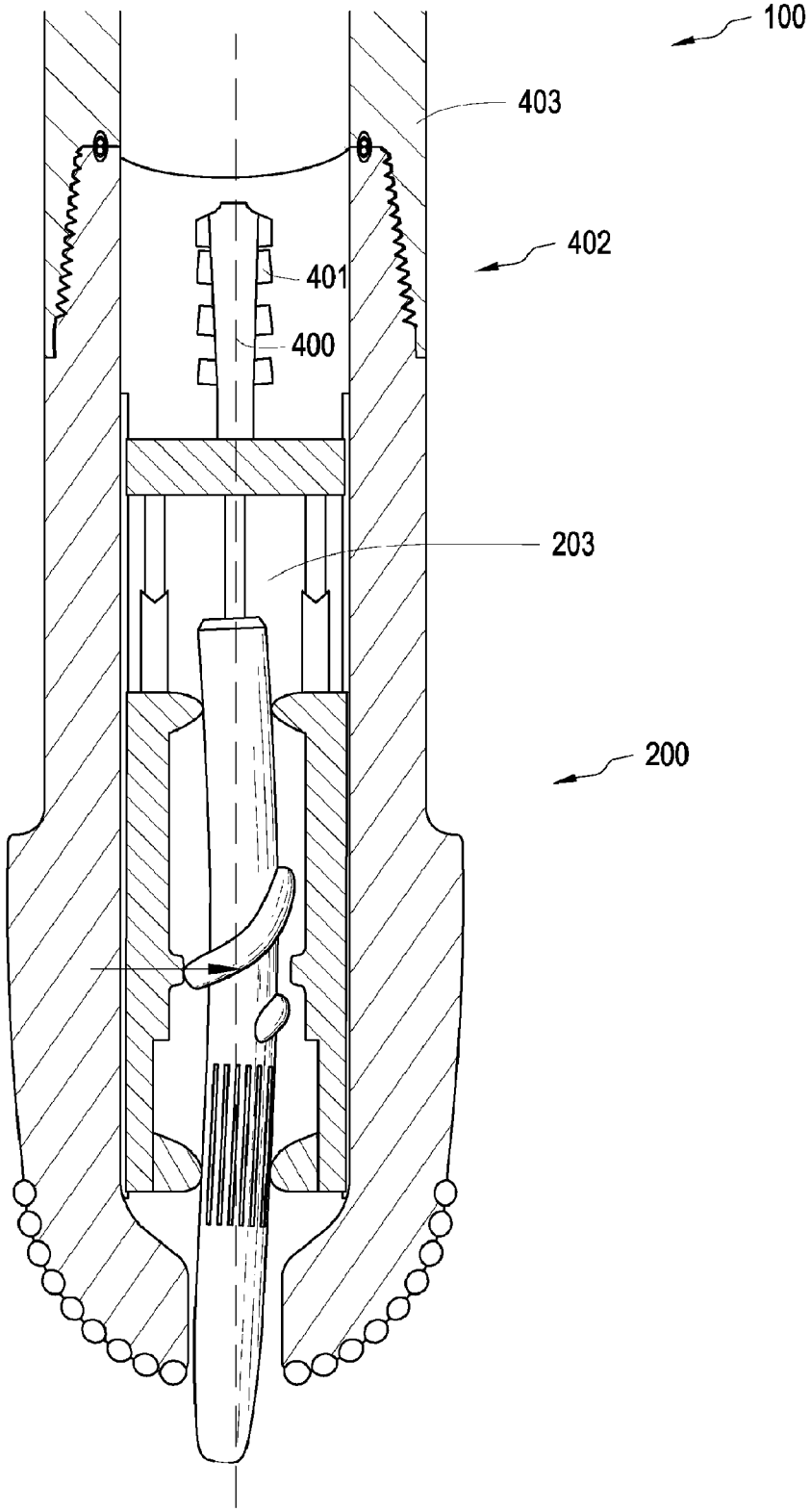
FIG. 5 is a cross sectional diagram of another embodiment of a drill bit assembly.

FIG. 5 is a cross sectional diagram of another embodiment of a drill bit assembly 100. The assembly 100 comprises a turbine 400 located at least partially within the chamber 203 of the body portion 200, the turbine 400 being adapted to drive the hydraulic circuit. As drilling mud passed over the blades 401 of the turbine 400, the turbine 400 will rotate at a different speed than the body portion of the drill bit assembly 100, which differential rotation may be used to drive the hydraulic circuit and therefore steer the downhole tool string 101. Also the shank portion 402 of the assembly 101 is connected to a downhole tool string component 403. The downhole tool string component may be selected from the group consisting of drill pipe, casing, drill collars, subs, heavy weight pipe, or reamers. In some embodiments of the present invention, portions of the shaft, the sleeve, turbines, or chamber may also be located within the downhole tool string component 403.

Figure 6:
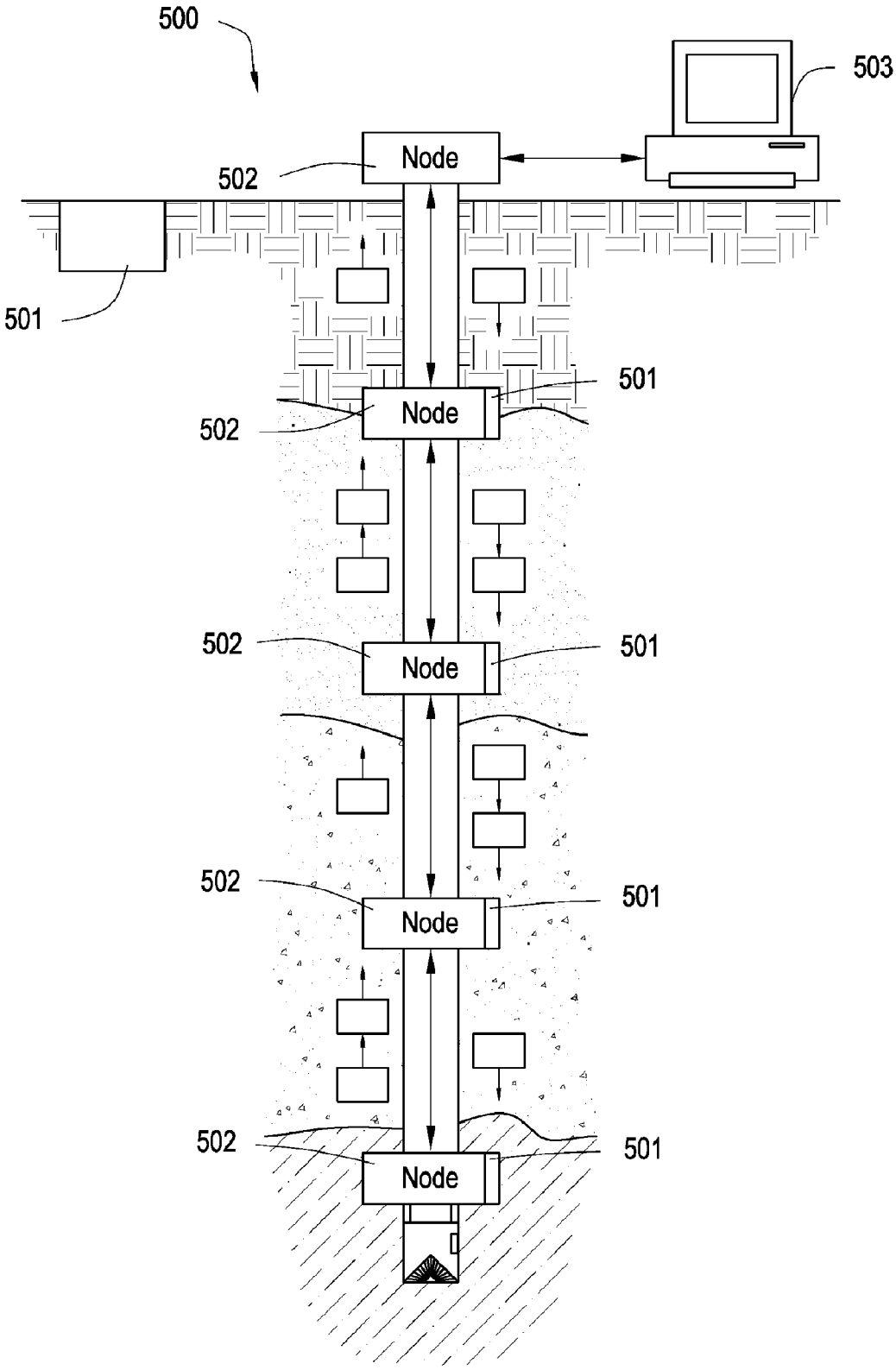
FIG. 6 is a perspective diagram of an embodiment of a downhole network.

FIG. 6 is a perspective diagram of an embodiment of a downhole network 500. Sensors 501 which are associated with nodes 502 may be spaced along the tool string and be in communication with each other. The sensors 501 may record an analog signal and transmit it to an associated node 502, where is it converted to digital code and transmitted to the surface via packets. In the preferred embodiment, an inductive transmission element disclosed in U.S. Pat. No. 6,670,880; which is herein incorporated by reference for all that is contains; is disposed in a groove formed in the secondary shoulder at both the pin and box ends of a downhole tool string component. The signal may be passed from one end of the downhole component to another end via a transmission media secured within the tool string component. At the ends of the tool string component, the signal is transferred into a magnetic signal by a transmission element and passed through the interface of the two tool sting components. Another transmission element in the adjacent tool string component receives and converts the signal back into an electrical signal and passes it along another transmission media to the other end of the adjacent tool string component. This process may be repeated until the signal finally arrives at surface equipment, such as a computer, or at a downhole location. The signal may attenuate each time it is converted to a magnetic or electric signal, so at least one of the nodes may comprise a repeater or amplifier to either repeat or amplify the signals. A server 503 may be located at the surface which may communicate the downhole information to other locations via local area networks, wireless transceivers, satellites, or cables.

The network 500 may enable valves, hydraulic circuits, actuators, or other devices to be controlled by local or remote intelligence. Surface equipment or downhole electronics may monitor the azimuth, pitch, and/or inclination of the drill bit assembly through the use of magnetometers, accelerometers, gyroscopes or another position sensing device and be transmitted over the network 500 or through a mud pulse system, such that it may be analyzed in real time. It may be determined from the data that the drill bit assembly is leading the tool string along the desired trajectory or that adjustments ought to be made. Such adjustments may be made by controlling the shaft.

FIG. 2 is a cross sectional diagram of the preferred embodiment of a drill bit assembly 100. A proximate end 601 of the shaft 204 is disposed within a closed end 602 of the chamber 203 and a distal end 217 of the shaft 204 comprises an asymmetric geometry 603. Rotary bearings 604 help to rotationally isolate the shaft 204 from the body portion 200 of the assembly 100. The rotary bearings 604 may be plain bearings, ball bearings, roller bearings, tapered bearings, or combinations thereof. The bearings 604 may also comprise a material selected from the group consisting of steel, stainless steel, aluminum, ceramic, diamond, polycrystalline diamond, boron nitride, silicon nitride, tungsten, mixtures, alloys, or combinations thereof. In some embodiments, (not shown) rotary bearings 604 may be used to rotationally isolate the distal end 217 of the shaft 204 from the proximate end 601; in such embodiments, the proximate end 601 may be rotationally fixed to the body portion 200. As the shaft 204 engages the formation 600, the distal end 217 of the shaft 204 may rotational fix with the formation 600 and the body portion 200 may rotate around it. The asymmetric geometry 603 may direct the drill bit assembly 100 along the desired direction 610.

When the angle or direction of the desired trajectory changes, the asymmetric geometry of the shaft may be repositioned by using a brake 605 disposed within the body portion 200 to engage the shaft 204 and rotationally fix the shaft 204 with the body portion 200. The brake 605 may release the shaft 204 when the asymmetric geometry 603 is aligned with the desired trajectory. The brake 605 may comprise a latch, hydraulics, a magnetorheological fluid, eletrorheological fluid, a magnet, a piezoelectric material, a magnetostrictive material, a piston, a sleeve, a spring, a solenoid, a ferromagnetic shape memory alloy, swash plate, a collar, a gear, or combinations thereof. The brake 605 may also be controlled over the downhole network 500 or activated through a mud pulse system. In situations where it is desirable to drill in a straight line, the brake 605 may engage the shaft 204 and rotationally fix it to the body portion 200 of the assembly 100. In some embodiments of the present invention, a rotary seal (not shown) may be used to keep debris from entering the chamber and affecting the bearings 604 and/or brake 605.

In some embodiments, there may be at least one magnet 611 disposed within the shaft 204. The position of the at least one magnet 611 may be determined by sensors 612 disposed within the body portion 200 of the assembly 100. In such a manner the orientation of the shaft 204 may be determined.

Still referring to FIG. 2, a nozzle 606 is disposed within the working portion 201 of the drill bit assembly 100. The nozzle 606 may be used to cool the drill bit assembly 100, which may include cooling the cutting elements 202, the shaft 204, and any electronics or any other devices disposed within the body portion 200. The nozzles 606 may also provide the standard benefits of removing debris and also helping to break up the formation 600. A profile 607 of the formation 600 formed by the working end 201 may be at least partially degraded by the fluid pressure released from the nozzles. It is believed that by optimizing the orientation and pressures of the nozzles 606 an optimal rate of degrading the profile and/or an effective rate for removing debris may be obtained. In some embodiments, the nozzles 606 may be angled such so as to help weaken the formation 600 in the direction of the desired trajectory.

FIGS. 7-13 disclose several asymmetric geometries that may be used with the present invention. It is believed that certain asymmetric geometries may have various advantages over other asymmetric geometries depending on the characteristics of the formation. Such characteristic may include hardness, formation pressure, temperature, salinity, pH, density, porosity, and elasticity. In some embodiments, all the geometries shown in FIGS. 7-13 may comprise superhard coatings although they are not shown.

Figure 7:
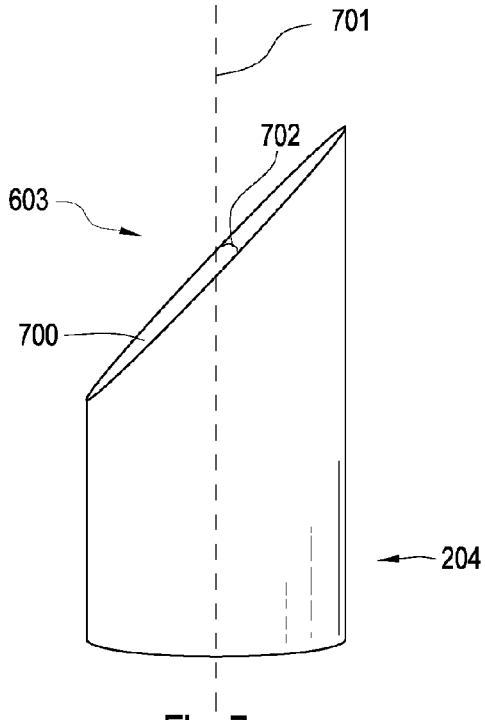
FIG. 7 is a perspective diagram of an embodiment of a distal end of a shaft.
Figure 8:
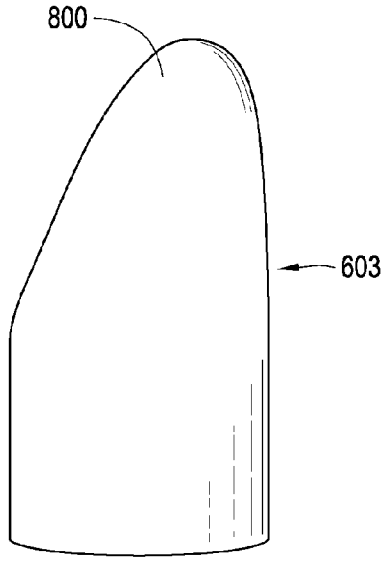
FIG. 8 is a perspective diagram of another embodiment of a distal end of a shaft.
Figure 9:
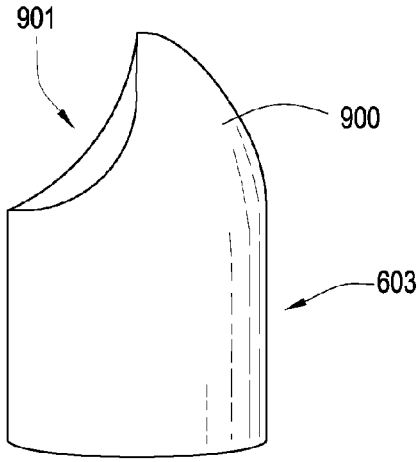
FIG. 9 is a perspective diagram of another embodiment of a distal end of a shaft.
Figure 10:
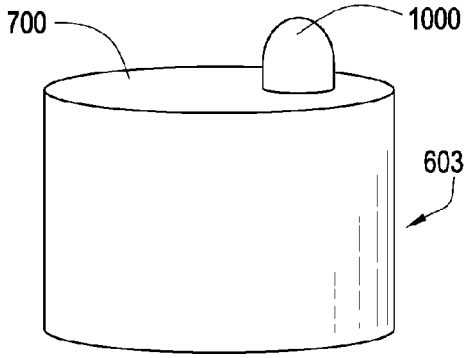
FIG. 10 is a perspective diagram of another embodiment of a distal end of a shaft.
Figure 11:
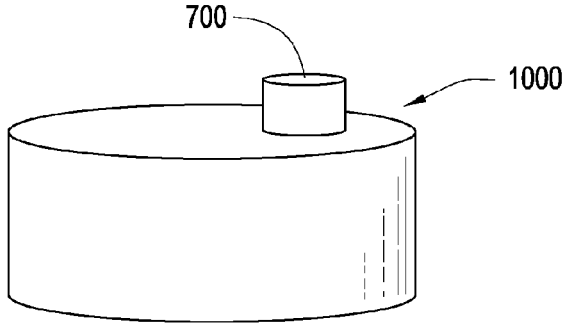
FIG. 11 is a perspective diagram of another embodiment of a distal end of a shaft.
Figure 12:
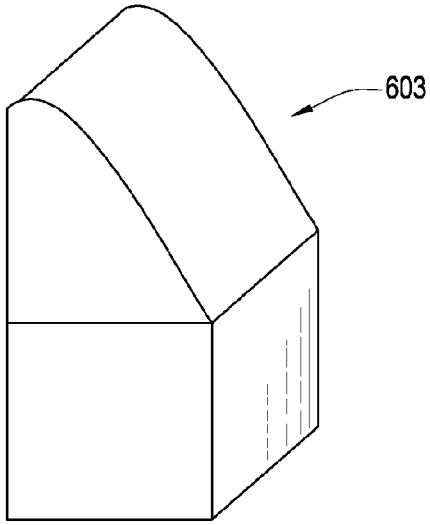
FIG. 12 is a perspective diagram of another embodiment of a distal end of a shaft.
Figure 13:
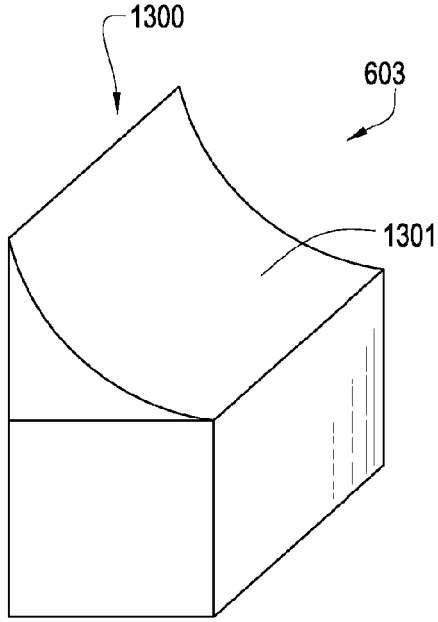
FIG. 13 is a perspective diagram of another embodiment of a distal end of a shaft.

FIG. 7 shows an asymmetric geometry 603 with a substantially flat face 700, the face 700 intersecting a central axis 701 of the shaft 204 at an angle 702 between 1 and 89 degrees. Ideally, the angle 702 is within 30 to 60 degrees. FIG. 8 shows a geometry 603 of an offset cone 800. FIG. 9 shows an asymmetric geometry 603 of a cone 900 comprising a cut 901. The cut 900 may be concave, convex, or flat. FIG. 10 shows a geometry 603 of a flat face 700 with an offset protrusion 1000. The embodiment of FIG. 11 shows an offset protrusion 1000 with a flat face 700. The asymmetric geometry 603 of FIG. 12 is generally triangular. In other embodiments, the asymmetric geometry 603 may be generally pyramidal. FIG. 13 shows an asymmetric geometry 603 of a generally triangular distal end 1300 with a concave side 1301.

Various actuators may be used to control the shaft of the drill bit assembly. It is believed that precisely controlling the shaft will enable steering along complicated trajectories. The actuator may comprise a sleeve, such as the sleeves described in FIGS. 2-4. The actuator may also comprise a latch, a brake, hydraulics, a magnetorheological fluid, eletrorheological fluid, a magnet, a piezoelectric material, a magnetostrictive material, a piston, a spring, a solenoid, a ferromagnetic shape memory alloy, a swash plate, a gear, or combinations thereof. Further, the actuator may apply a force on the shaft in a variety of ways.

Figure 14:
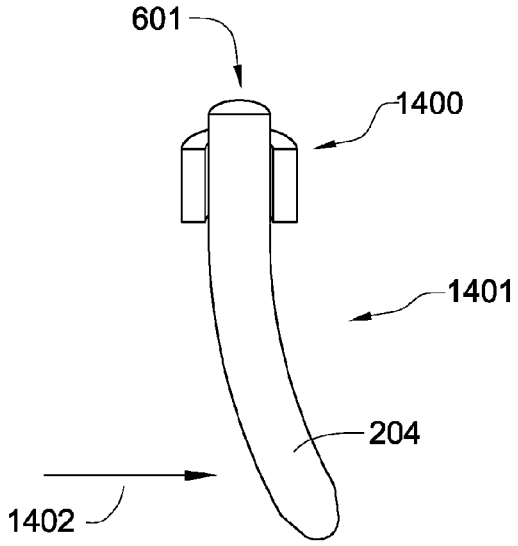
FIG. 14 is a perspective diagram of an embodiment of applying a substantially normal force to a shaft.
Figure 15:
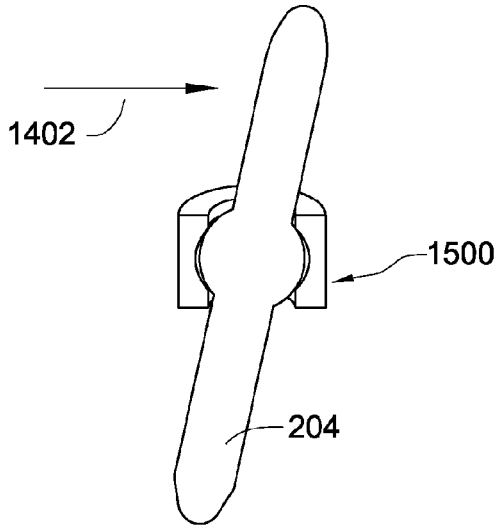
FIG. 15 is a perspective diagram of another embodiment of applying a substantially normal force to a shaft.
Figure 16:
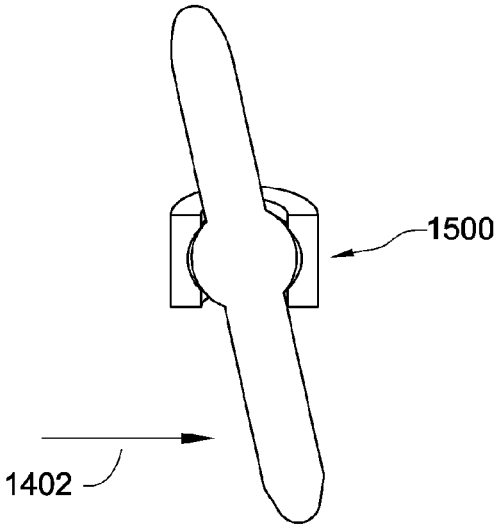
FIG. 16 is a perspective diagram of another embodiment of applying a substantially normal force to a shaft.

FIGS. 14-21 depict forces, represented by arrows, to illustrate how an actuator may control, move, orient, and/or manipulate the shaft. The shaft is shown without the other components of the drill bit assembly for clarity. It is to be remembered for the embodiments of FIGS. 14-21, that at least a portion of the shafts are disposed within the chamber and that the shafts are rotationally isolated from the body portion of the drill bit assembly. FIG. 14 shows a shaft 204 with a fixed portion 1400 near or at the proximate end 601. A substantially normal force 1402 is applied (by an actuator) to a free portion 1401 below the fixed portion 1400 causing the shaft to bend. FIG. 15 shows a secured mid-portion 1500 of the shaft 204 and a substantially normal force 1402 being applied above the secure mid-portion 1500 such that the shaft 204 pivots at the secure mid-portion 1500. FIG. 16 shows an embodiment similar to the embodiment of FIG. 15, except the force 1402 is applied below the secured mid-portion 1500.

Figure 17:
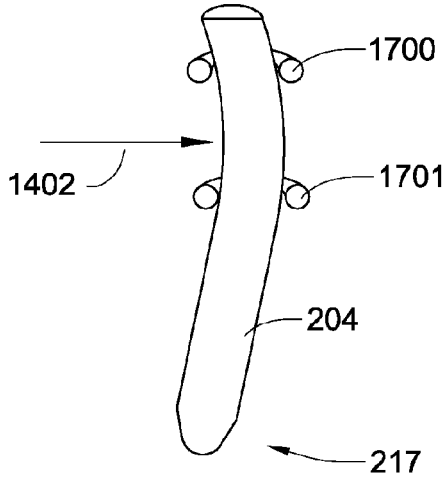
FIG. 17 is a perspective diagram of another embodiment of applying a substantially normal force to a shaft.

FIG. 17 shows another embodiment of bending the shaft 204. In this embodiment, there are at least two fixed points 1700 and 1701. The first and second fixed point 1700, 1701 may be located within the chamber. In some embodiments the wall of the chamber's opening may engage the shaft 204 as it is moved by the substantially normal force 1402 such that the opening's wall acts as a fulcrum forming the second fixed point 1701. The wall of the opening or any other object which may be used as a fulcrum may be angled or comprise a geometry such that when a normal force 1402 is applied between the fixed points 1700, 1701 the distal end 217 of the shaft 204 does not necessarily move in a direction opposite of the normal force 1402.

Figure 18:
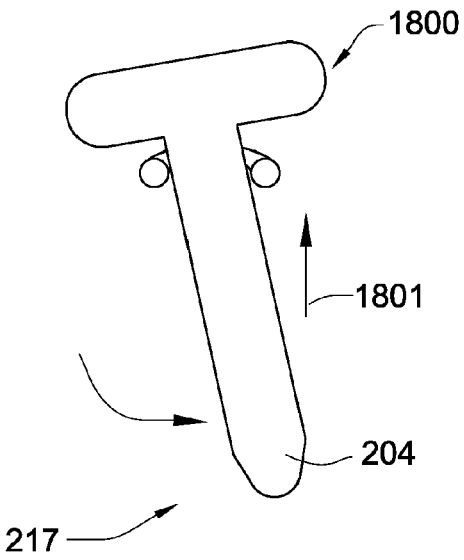
FIG. 18 is a perspective diagram of an embodiment of applying a substantially axial force to a shaft.
Figure 19:
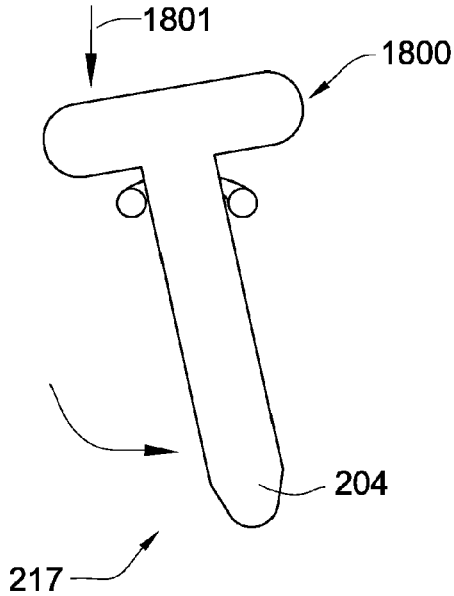
FIG. 19 is a perspective diagram of another embodiment of applying a substantially axial force to a shaft.
Figure 20:
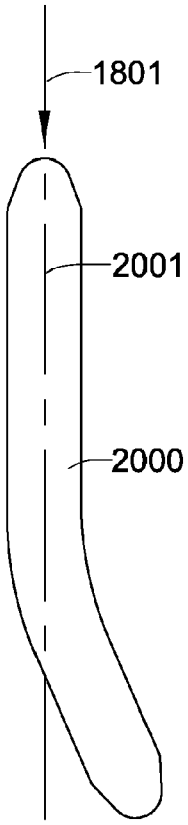
FIG. 20 is a perspective diagram of another embodiment of applying a substantially axial force to a shaft.
Figure 21:
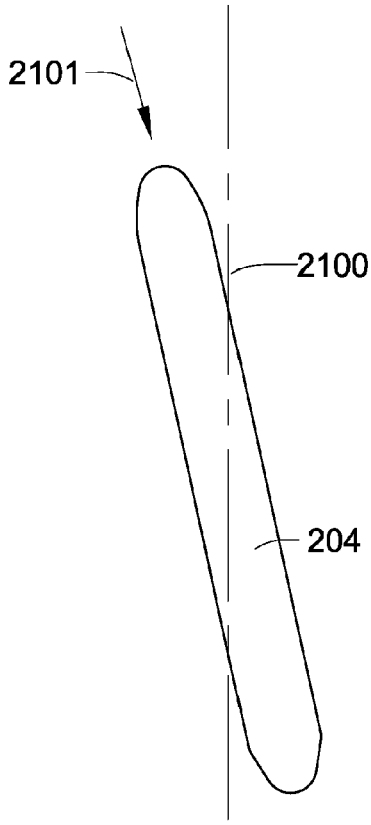
FIG. 21 is a perspective diagram of an embodiment of a applying a substantially diagonal force to a shaft.

FIGS. 18 and 19 depict a shaft 204 with a geometry 1800 such that a substantially axial force 1801 may be applied either from above or below the geometry 1800. As the substantially axial force 1801 engages the geometry 1800, the shaft 204 may rock causing the distal end 217 to move. FIG. 20 shows a permanently bent shaft 2000. The shaft 2000 may be retracted within the chamber until it is desired to steer the tool string in new direction. In such an embodiment, a substantially axial force 1801 may push the permanently bent shaft 2000 into the formation. The permanently bent shaft 2000 may be rotated along a central axis 2001 within the chamber before it is pushed such that the permanently bent shaft 2000 may engage the formation in variety of directions. FIG. 21 shows a shaft 204 angled with respect to a central axis 2100 of the drill bit assembly. A diagonal force 2101 may be applied to the shaft 204 such that the shaft 204 will engage the formation. It is; however, believed that a diagonal force 2101 is actually comprised of both normal and axial forces 1402, 1801.

Figure 22:
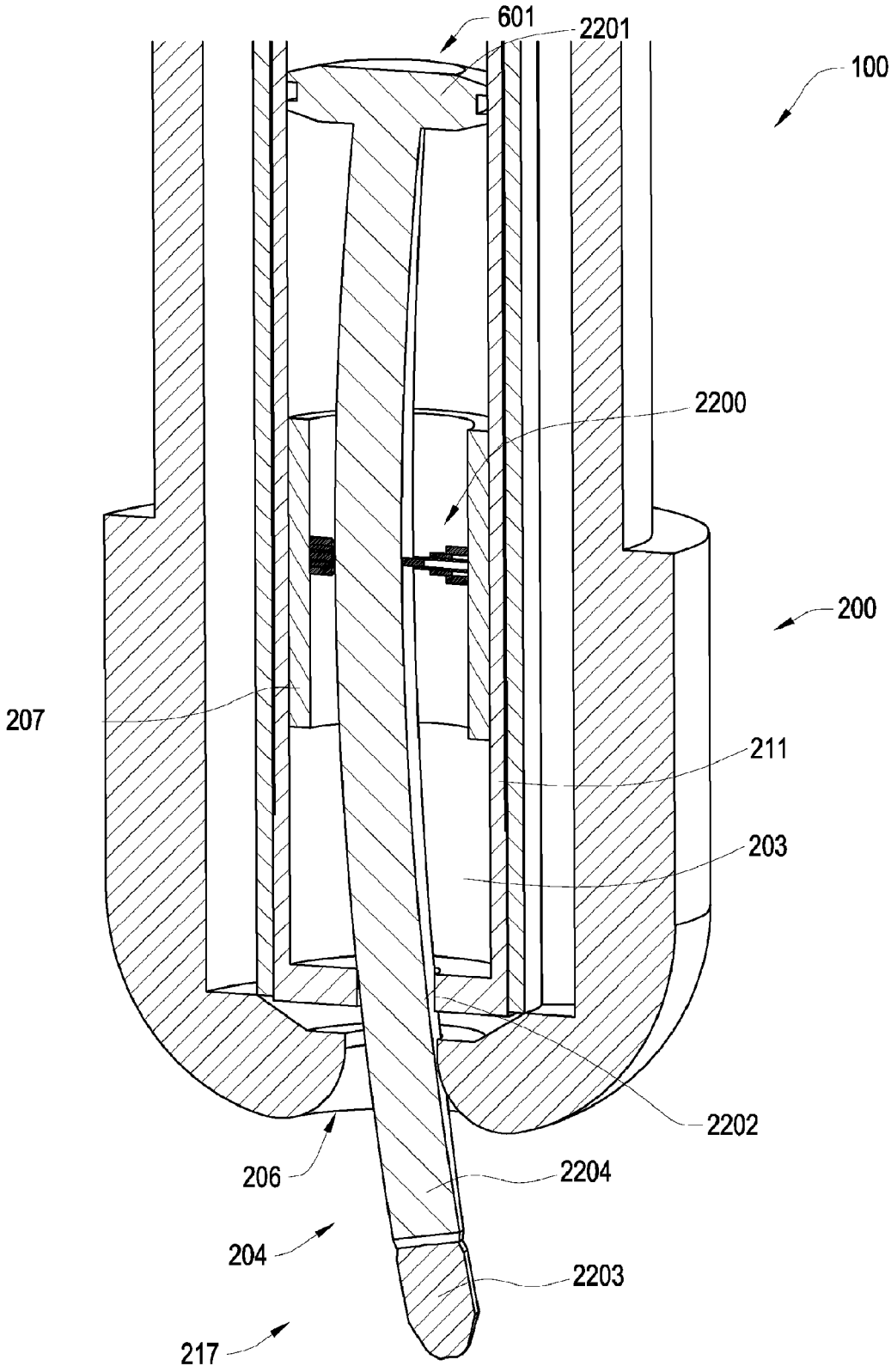
FIG. 22 is a cross sectional diagram of an embodiment of a drill bit assembly.

FIG. 22 is a cross sectional diagram of another embodiment of a drill bit assembly 100. In this embodiment, an actuator 2200 is disposed within a sleeve 207. The actuator 2200 and the sleeve 207 are both rotationally isolated from the body portion 200 of the assembly 100. The actuator 2200 is adapted to extend and engage the shaft 204. The proximate end 601 of the shaft 204 is fixed by an enlarged portion 2201 of the shaft 204 and the wall 2202 near the opening 206 acts as a fulcrum angling the distal end 217 of the shaft 204 in a different direction than the direction of the substantially normal force being generated by the actuator 2200. The actuator 2200 may be extended hydraulically. Valves (not shown) may be located between the sleeve 207 and the wall 211 of the chamber 203. In other embodiments an inductive coupler may signal and/or supply electric power to extend an actuator 2200 comprising a solenoid, a piezoelectric material or a magnetostrictive material. The distal end 217 of the shaft 204 comprises a hard material 2203 such as tungsten carbide, which may be bonded to the remaining portion 2204 of the shaft 204. The hard material 2203 may have a coating of a superhard material such as diamond, polycrystalline diamond, or cubic boron nitride. The superhard material may be bonded to the hard material 2203 with a non-planar interface. In some embodiments the superhard material may have a leeched portion.

Figure 23:
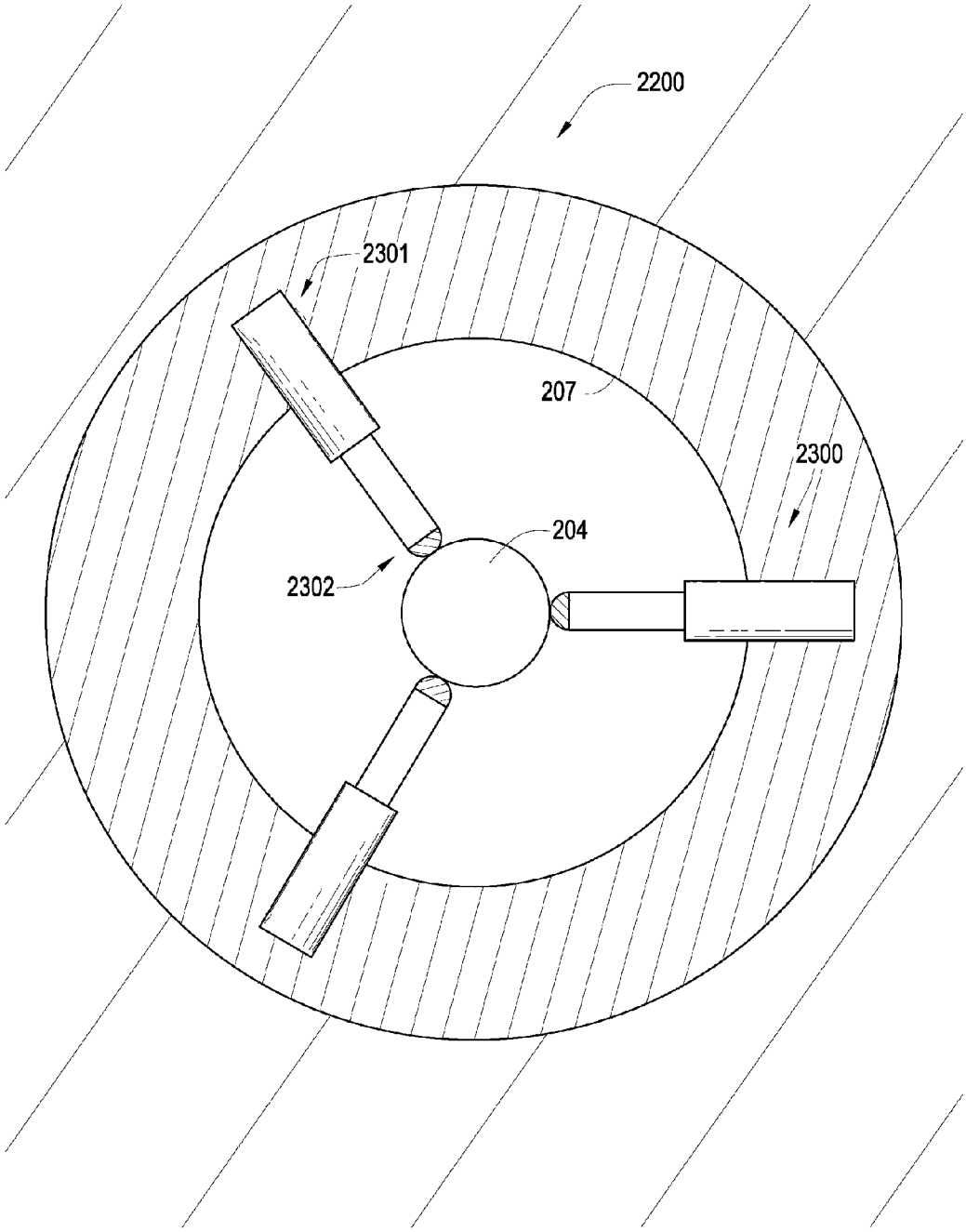
FIG. 23 is a cross sectional diagram of an embodiment of an actuator for moving at least a portion of a shaft.

FIG. 23 is a cross sectional diagram of an embodiment of an actuator assembly 2200 for moving at least a portion of a shaft 204. The actuator assembly 2200 may comprise three telescoping arms 2300 which extend due to hydraulic pressure or from electric or magnetic signals. A first end 2301 of the telescoping arms 2300 may be secured within the sleeve 207 and a second end 2302 may be adapted to engage the shaft 204. The second end 2302 may be rounded such that it may engage the shaft 204 at a variety of angles.

Figure 24:
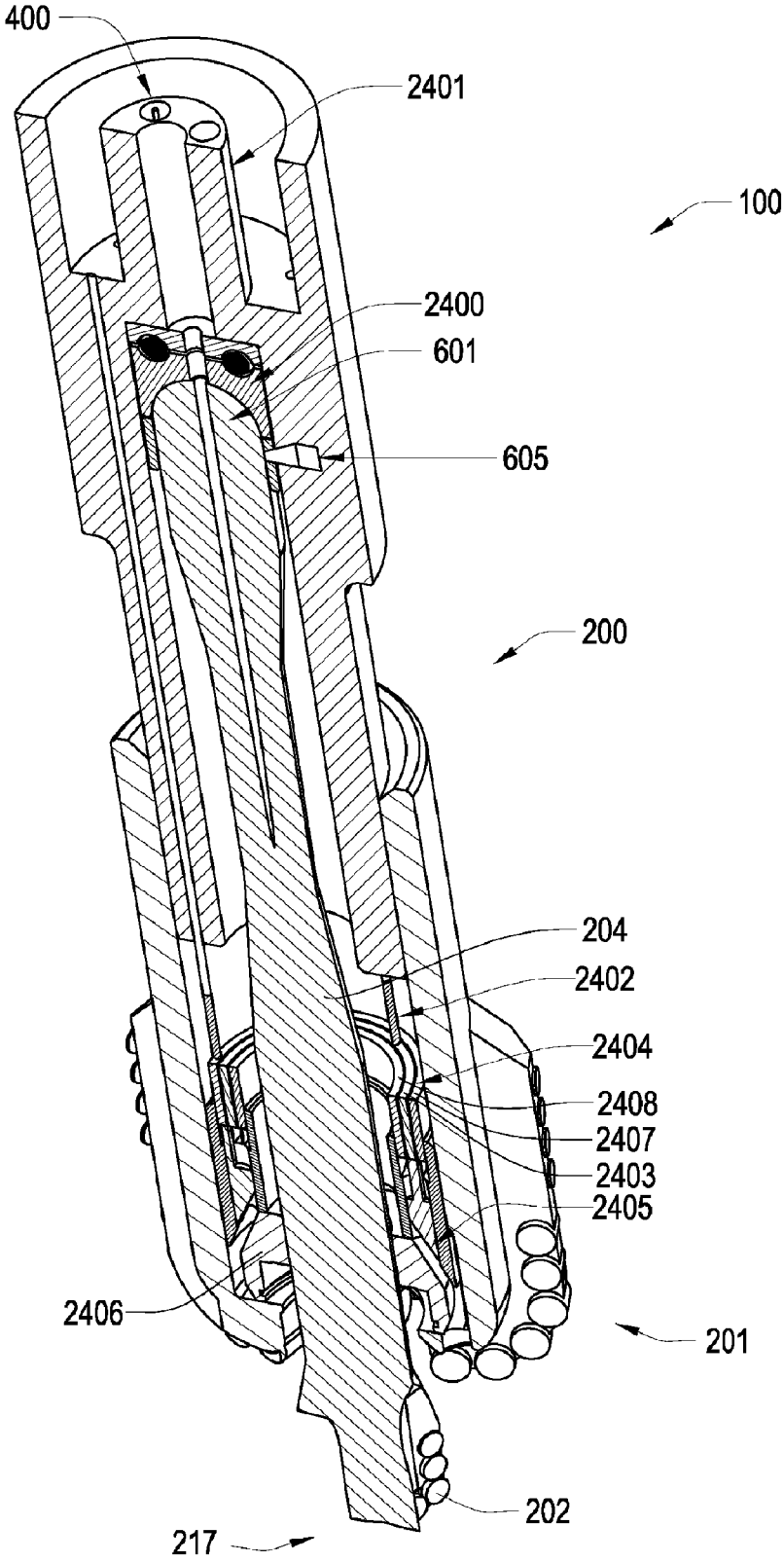
FIG. 24 is a cross sectional diagram of another embodiment of a drill bit assembly.

FIG. 24 is a cross sectional diagram of another embodiment of a drill bit assembly 100. In this embodiment, the proximate end 601 of the shaft 204 is fitted within a rotationally isolated socket 2400. A brake 605 is disposed within the body portion 200 of the assembly 100 and adapted to engage the shaft 204 such that, when desired, the shaft 204 may be rotationally fixed to the body portion 200. A turbine 400 may be located proximate the rotationally isolated socket 2400 and may be protected in a housing 2401; the turbine being adapted to drive a hydraulic circuit. The hydraulic circuit may be used to control actuators which are adapted to move the shaft 204 relative to the working portion 201 and also steer the tool string. Hydraulic power from drilling mud may also be used to drive the hydraulic circuit.

The actuator may comprise at least one rod 2402 which is adapted to engage at least one ring 2403 when exposed to hydraulic pressure. The ring 2403 may comprise a receiving end 2404 and a tapered end 2405, the ring 2403 being positioned such that its receiving end 2404 is adapted for engagement by the rod 2402. The tapered end 2405 is adapted to engage a tapered plate 2406 when the ring 2403 is engaged by the rod 2402. The tapered plate 2406 may be in mechanical communication with the shaft 204 such that when the rod 2402 engages the ring 2403, the tapered end 2405 of the ring 2403 pushes the tapered plate 2406 and applies a substantially normal force to shaft 204. As shown in FIG. 24, there may be three rings 2403, 2407, 2408, each ring being adapted to apply a substantially normal force from a different direction to the shaft 204. By engaging more than one of the rings 2403, 2407, 2408 to the tapered plate 2406 at once the shaft 204 may be moved relative to the working portion 201 in a variety of directions. In some embodiments, if all of the rings 2403, 2407, 2408 are engaging the tapered plate 2406 uniformly, a portion of the drill bit assembly 100 may telescopingly extend.

The rings 2403, 2407, 2408 along with the tapered plate 2406 make up a steering bias unit. This unit is fixed such that it can rotate inside the body portion 200 at different RPM rates which are substantially concentric to each other. The shaft 204 is retained within the center of the bias unit such that it may move eccentric to the body portion 200. This allows the drill bit assembly to see tangential forces while rotating when the shaft 204 is fixed relative to the formation, creating tool-face pressure and deviation.

When the shaft 204 and body portion 200 both rotate eccentric to each other during drilling this arrangement effectively constitutes a bi-center drill bit assembly. The bias unit may deviate along multiple azimuths as well to share wear with all of the side cutting elements. This effectively increases tool life over a standard bi-center drill bit assembly.

In this embodiment, the shaft 204 also comprises a plurality of cutting elements 202. As the substantially normal forces are applied to the shaft 204, the distal end 217 of the shaft 204 may simply push off of the formation and angle the drill bit assembly 100 in a desired direction. The hydraulic circuit may comprise valves which may be controlled over the network 500 (See FIG. 6). In such an embodiment, the brake 605 and the orientation of the shaft 204 relative to the working portion 201 may be controlled remotely, either at the surface or it may be controlled by a device located downhole. Gyroscopes, magnetometers, or accelerometers may be disposed within the body portion 200 of the assembly 100 and may communicate the orientation of the drill bit assembly 100 to a remote device over the network 500. Further other gyroscopes, magnetometers, or accelerometers may be disposed within the shaft 204 such that the remote device may also know the shaft's orientation. The gyroscope in the shaft 204 may be in electromagnetic communication with the network 500 through a rotary inductive coupling. Such an inductive coupling is disclosed in U.S. Patent Publication 2004/0113808, which is herein incorporated by reference for all that it contains.

Figure 25:
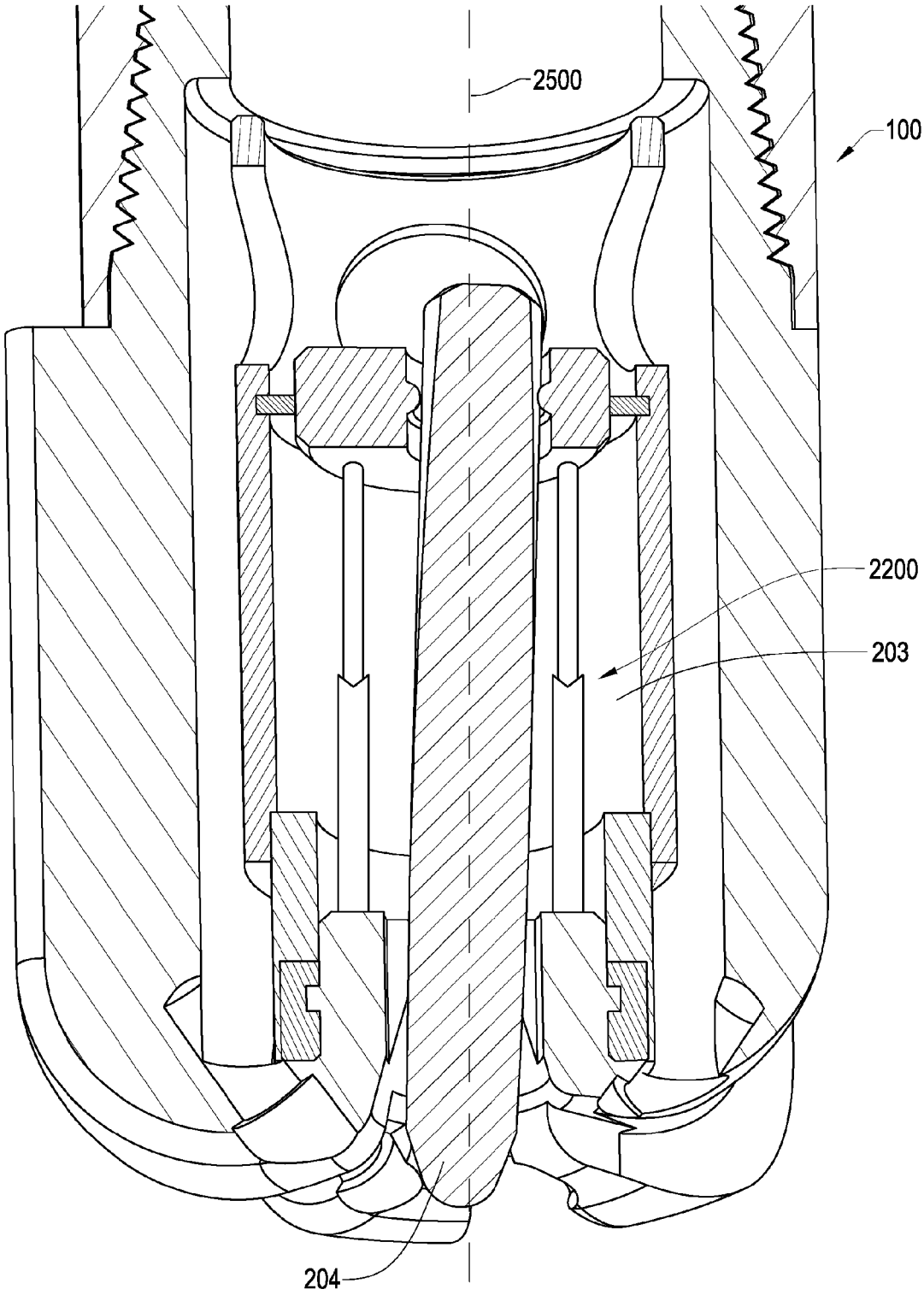
FIG. 25 is a cross sectional diagram of another embodiment of a drill bit assembly.
Figure 26:
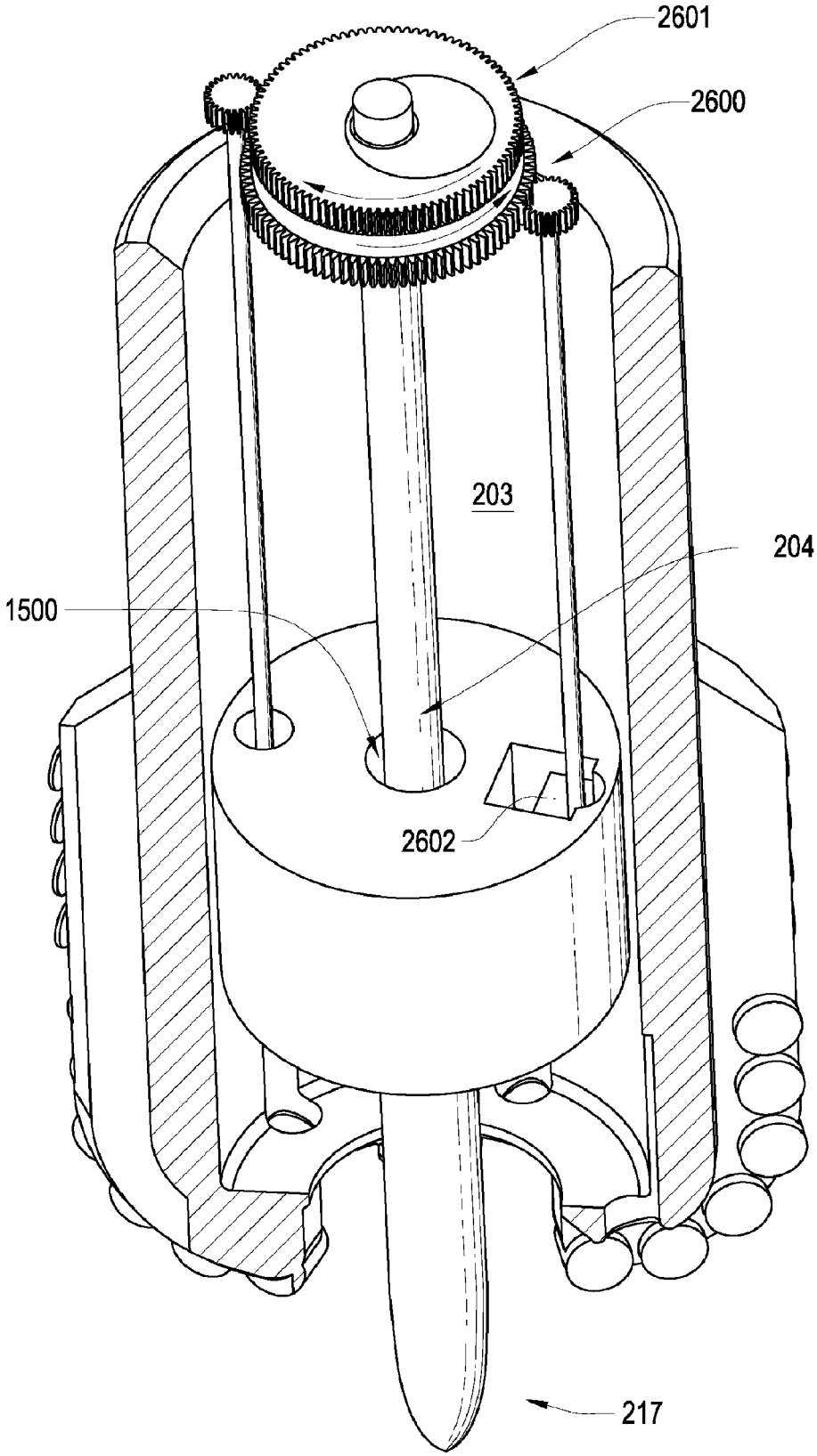
FIG. 26 is a cross sectional diagram of another embodiment of a drill bit assembly.

FIG. 25 is a cross sectional diagram of another embodiment of a drill bit assembly 100. The shaft 204 is permanently offset from a central axis 2500 of the assembly 100. Actuators 2200 may be used to retract and extend the shaft 204 into and out of the chamber 203. FIG. 26 shows a plurality of gears 2600, 2601 adapted to pivot the shaft 204 about a secure portion 1500. The first gear 2600 is adapted to adjust how far the shaft 204 is from a central axis 2500 of the assembly 100 and therefore the pitch at which the distal end 217 of the shaft 204 will engage the formation. The second gear 2061 is adapted to adjust the direction that the distal end 217 will engage the formation. The gears 2600, 2601 are in mechanical communication with a motor 2602 disposed within the chamber 203.

Figure 27:
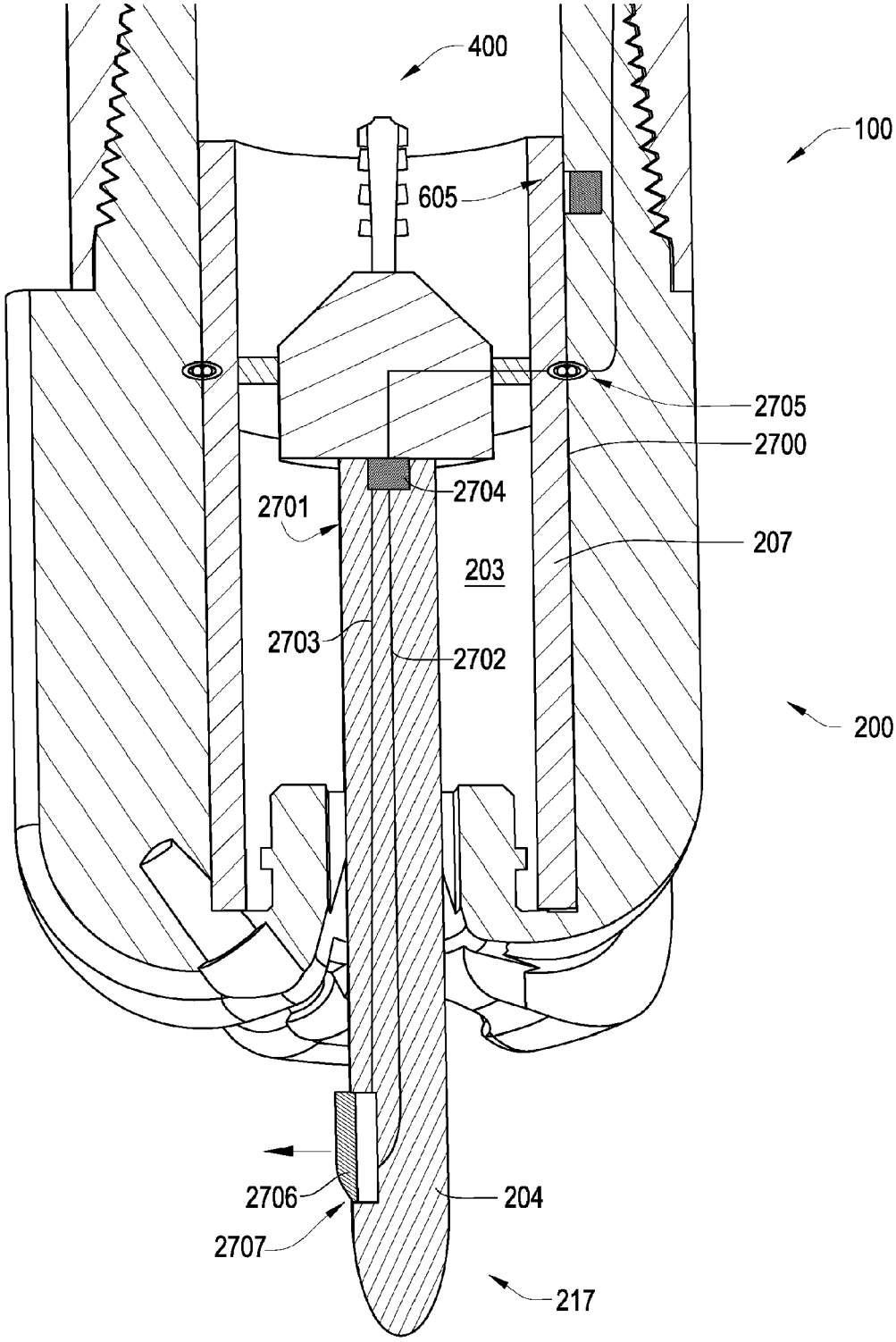
FIG. 27 is a cross sectional diagram of another embodiment of a drill bit assembly.

FIG. 27 is a cross sectional diagram of another embodiment of a drill bit assembly 100. A sleeve 207 with a low friction surface 2700 provides the shaft's rotational independence from the body portion 200. A turbine 400 also within the chamber 203 is adapted to engage drilling mud in such a manner that it may drive a pump (not shown) of a hydraulic circuit 2701 within the shaft 204. The hydraulic circuit 2701 comprises a pressurization line 2702 and an exhaust line 2703. A valve 2704 may be controlled over the downhole network 500 (see FIG. 6). A rotary coupling 2705, such as the rotary coupling described in U.S. Patent Publication 2004/0113808, may be used. In other embodiments, electrically conducting slip rings may be used. The pressurization line 2702 may be used to bias an extending member 2706 proximate the distal end 217 of the shaft 204. The extending member 2706 may be wide to help ensure that the extending member 2706 will push against the formation and not penetrate it. Also the extending member 2706 may comprise a bevel 2707 for preventing the extending member 2706 for getting caught. The exhaust line 2703 may be used to retract the extending member 2706. A brake 605 may also be used in this embodiment to temporarily rotationally fix the shaft 204 with the body portion 200 so that the extending member 2706 may be selectively placed. In other embodiments, there may be more than one extending member such that the shaft 204 may steer the tool string in more than one more direction.

Figure 28:
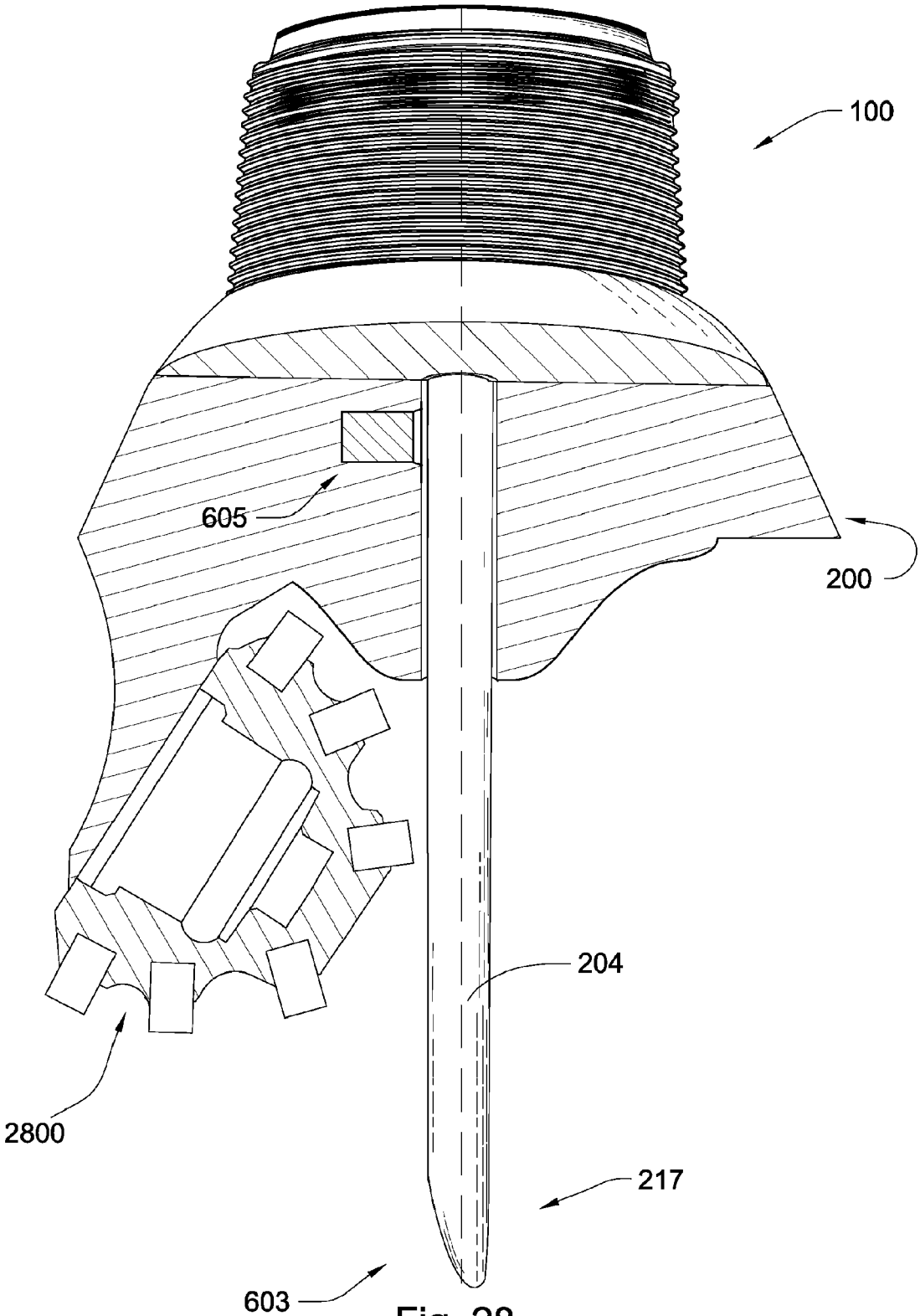
FIG. 28 is a cross sectional diagram of another embodiment of a drill bit assembly.

FIG. 28 shows an embodiment of a rotationally isolated shaft 204 in a drill bit assembly 100 comprising roller cones 2800. The distal end 217 of the shaft 204 may comprise an asymmetric geometry 603 and the body portion 200 of the assembly 100 may comprise a brake 605. This embodiment may function similar to the embodiments described in relation to FIG. 2.

Figure 29:
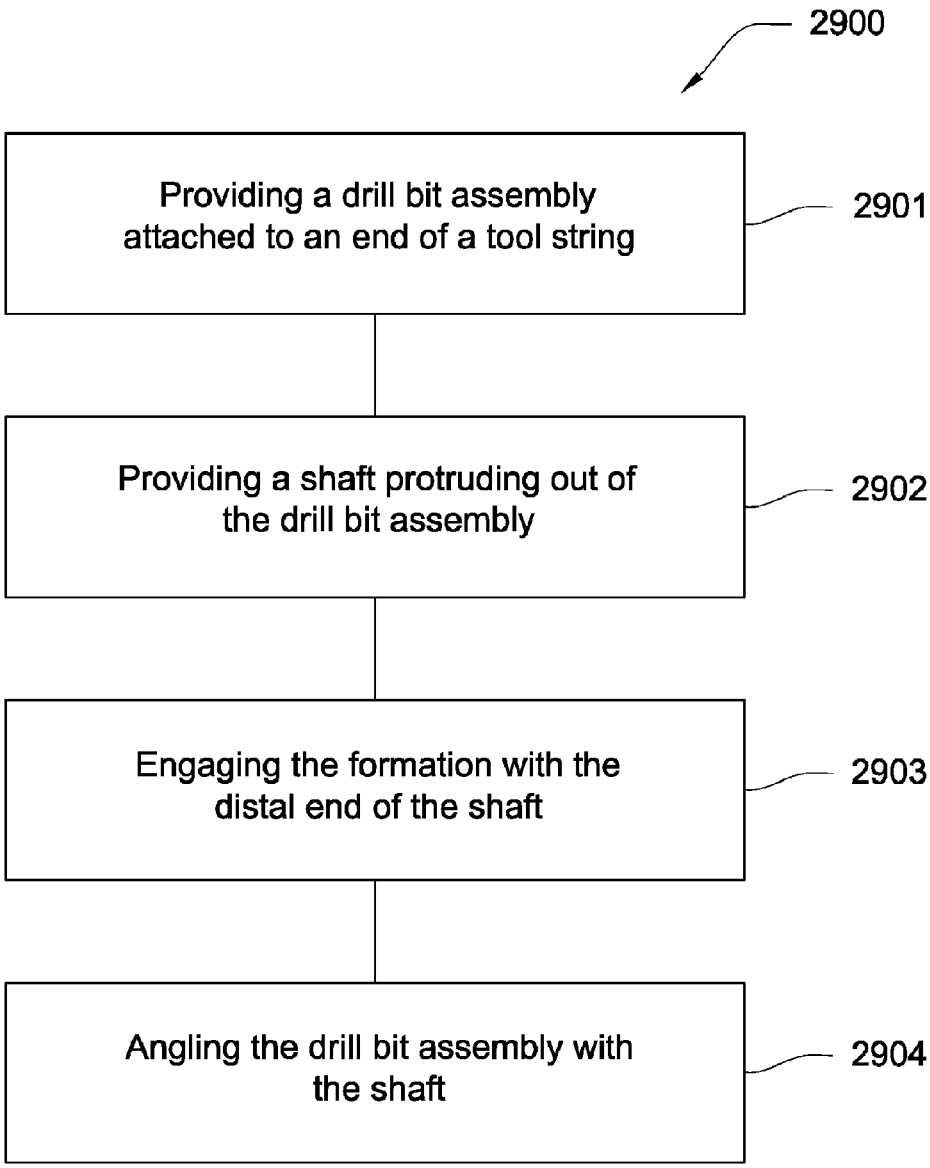
FIG. 29 is a diagram of a method for steering a downhole tool string.

FIG. 29 is a diagram of a method 2900 for steering a downhole tool string. The method comprises the steps of providing 2901 a drill bit assembly attached to an end of the tool string disposed within a bore hole; providing 2902 a shaft protruding from a working portion of the drill bit assembly, the working portion comprising at least one cutting element; engaging 2903 the formation with a distal end of the shaft, the shaft being part of the drill bit assembly; and angling 2904 the drill bit assembly with the shaft along a desired trajectory. The step of angling the drill bit assembly with the shaft may comprise angling the shaft or the step may include pushing the drill bit assembly along the desired trajectory with the shaft. It is believed that if the shaft is loaded with enough pressure that the shaft will penetrate the formation, but if the shaft does not overcome the formation pressure, then the shaft may move the drill bit assembly by pushing off of the formation. A narrow distal end may aid in concentrating the pressure loaded to the shaft into the formation such that it may overcome the formation pressure and penetrate the formation; on the other hand, a blunt or wide distal end may prevent the shaft from penetrating the formation and allow the shaft to push off of the formation. In some embodiments, the shaft may advance along the desired trajectory before the drill bit assembly. The shaft may be at least partially disposed within a chamber generally coaxial with the shank portion of the assembly and the chamber may be disposed within a body portion of the assembly. Angling 2904 the drill bit assembly may be controlled over a downhole network.

In some embodiments, the shaft is rotationally isolated from the working portion of the drill bit assembly. This may be advantageous because it allows the shaft to remain on the desired trajectory even though the remainder of the drill bit assembly is rotating. In some embodiments of the method, the shaft may also rotate with the body portion of the drill bit assembly if there is a plurality of actuators timed to temporally move the shaft such that the distal end of the shaft stays on the desired trajectory.

Whereas the present invention has been described in particular relation to the drawings attached hereto, it should be understood that other and further modifications apart from those shown or suggested herein, may be made within the scope and spirit of the present invention.

What is claimed is:

1. A drill bit assembly, comprising:

a body portion intermediate a shank portion and a working portion;

the working portion comprising at least one cutting element; and at least a portion of a shaft is disposed within the body portion and protrudes from the working portion; and the shaft comprising a distal end rotationally isolated from the body portion; wherein during a drilling operation, a distal end of the shaft is rotationally stationary with respect to a subterranean formation and the body portion is adapted to rotate around the shaft.

2. The drill bit assembly of claim 1, wherein the assembly further comprises an actuator adapted to move the shaft relative to the working portion.

3. The drill bit assembly of claim 2, wherein the actuator is also rotationally isolated from the body portion.

4. The drill bit assembly of claim 2, wherein the actuator moves the shaft parallel, normal, or diagonally with respect to an axis of the body portion.

5. The drill bit assembly of claim 2, wherein the actuator comprises a latch, hydraulics, a magnetorheological fluid, eletrorheological fluid, a magnet, a piezoelectric material, a magnetostrictive material, a piston, a sleeve, a spring, a solenoid, a ferromagnetic shape memory alloy, swash plate, a collar, a gear, or combinations thereof.

6. The drill bit assembly of claim 2, wherein the actuator is in communication with a downhole telemetry system.

7. The drill bit assembly of claim 1, wherein at least a portion of the shaft is disposed within a chamber formed in the body portion.

8. The drill bit assembly of claim 7, wherein a sleeve is disposed within the chamber and surrounds the shaft.

9. The drill bit assembly of claim 8, wherein the sleeve is also rotationally isolated from the body portion.

10. The drill bit assembly of claim 1, wherein the distal end comprises a superhard material.

11. The drill bit assembly of claim 1, wherein the shank portion is adapted for connection to a downhole tool string component.

12. The drill bit assembly of claim 1, wherein the shaft substantially shares a central axis with the shank portion.

13. The drill bit assembly of claim 1, wherein a brake is disposed within the chamber and is adapted to engage the shaft.

14. The drill bit assembly of claim 1, wherein the distal end of the shaft comprises an asymmetnc geometry.

15. A method for steering a downhole tool string, comprising:

providing a drill bit assembly attached to an end of the tool string disposed within a bore hole;

providing a shaft protruding from a working portion of the drill bit assembly, the working portion comprising at least one cutting element;

engaging the formation with a distal end of the shaft, the shaft being part of the drill bit assembly; and angling the drill bit assembly with the shaft along a desired trajectory;

wherein during a drilling operation, a distal end of the shall is rotationally stationary with respect to a subterranean formation and the body portion is adapted to rotate around the shaft.

16. The method of claim 15, wherein angling the drill bit assembly comprises pushing the drill bit assembly along the desired trajectory by the shaft.

17. The method of claim 15, wherein angling the drill bit assembly with the shaft comprises angling the shaft.

18. The method of claim 15, wherein the shaft advances along the desired trajectory before the drill bit assembly.

19. The method of claim 15, wherein the shaft is disposed within a chamber generally coaxial with a shank portion of the drill bit assembly.

20. The method of claim 15, wherein the shaft comprises an extending member for pushing against subterranean formation.

21. The method of claim 15, wherein the drill bit assembly comprises an actuator for angling the distal end of the shaft with respect to a shank portion of the assembly.

22. The method of claim 15, wherein the actuator is rotationally isolated from a working portion of the drill bit assembly.

23. The method of claim 15, wherein the shaft is rotationally isolated from the working portion of the drill bit assembly.

24. The method of claim 15, wherein the actuator for angling the drill bit assembly is controlled over a downhole network or a downhole tool.

25. The method of claim 15, wherein the distal end of the shaft comprises a superhard material.

* * * * *